US005660325A

United States Patent [19]

Zacher

[11] Patent Number: 5,660,325

[45] Date of Patent: Aug. 26, 1997

[54] CHILD RESISTANT PAPERBOARD CARTON

[75] Inventor: Raymond L. Zacher, West Chester, Ohio

[73] Assignee: Tenneco Packaging, Evanston, Ill.

[21] Appl. No.: 671,246

[22] Filed: Jun. 27, 1996

[51] Int. Cl.[6] ..... B65D 17/34

[52] U.S. Cl. ..... 229/235; 229/160.2; 229/240

[58] Field of Search ..... 229/102, 160.2, 229/206, 235, 240, 225, 924, 925

[56] References Cited

U.S. PATENT DOCUMENTS

| | | | |
|---|---|---|---|
| 2,909,312 | 10/1959 | Conerty | 229/235 |
| 3,186,581 | 6/1965 | Schneider et al. | 229/235 X |
| 3,263,900 | 8/1966 | Link et al. | 229/240 |
| 3,727,750 | 4/1973 | Petter | 229/235 X |
| 3,773,248 | 11/1973 | Cecil et al. | 229/235 X |
| 4,083,454 | 4/1978 | O'Neill | 229/240 |
| 5,012,929 | 5/1991 | Reosa | 229/222 X |
| 5,098,757 | 3/1992 | Steel | 229/235 X |
| 5,261,595 | 11/1993 | Nanno et al. | 229/235 |

FOREIGN PATENT DOCUMENTS

| | | | |
|---|---|---|---|
| 2846008 | 5/1980 | Germany | 229/206 |
| 2112745 | 7/1983 | United Kingdom | 229/206 |

*Primary Examiner*—Allan N. Shoap
*Assistant Examiner*—Christopher J. McDonald
*Attorney, Agent, or Firm*—Arnold, White & Durkee

[57] ABSTRACT

A method and mechanism for opening a paperboard carton that is child resistant. A dual-tab arrangement is used whereby one tab is removed to expose a second tab. The second tab is connected to a tape that is attached to and circles the interior of the carton. When the second tab is pulled it pulls with it the tape. The tape is pulled through the wall of the carton and sequentially severs the carton. The tape circles back to where the second tab was first pulled and, as a result, the carton is completely severed and the user is able to dispense the product contained within the carton.

15 Claims, 4 Drawing Sheets

FIG. 7
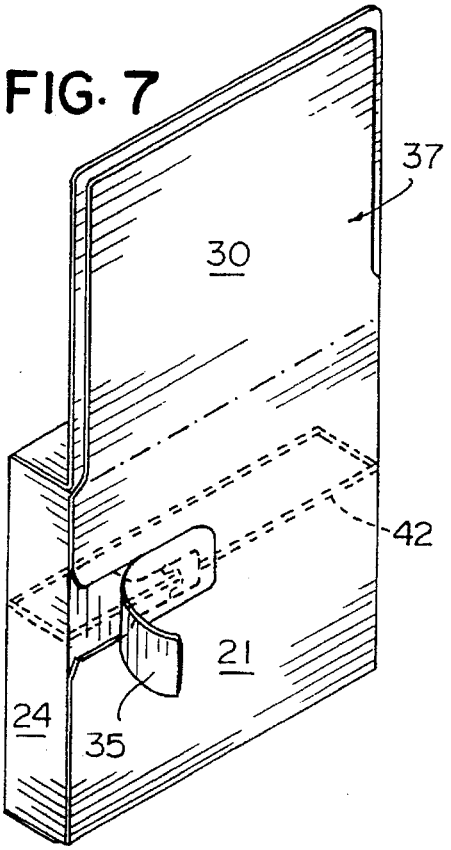
FIG. 8
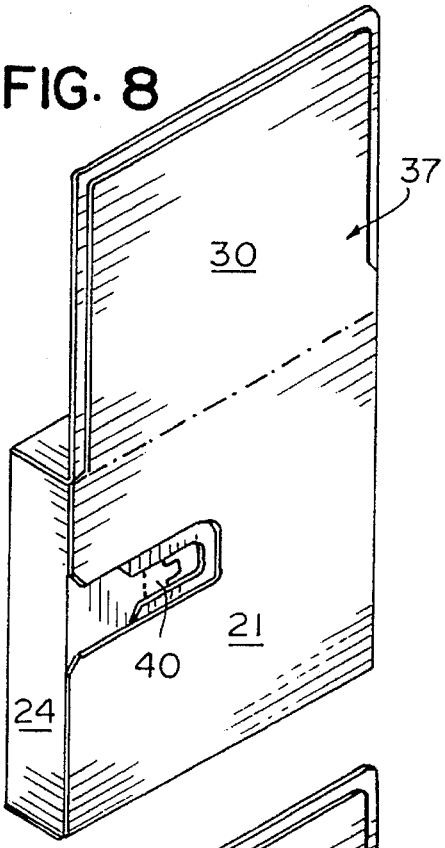
FIG. 9
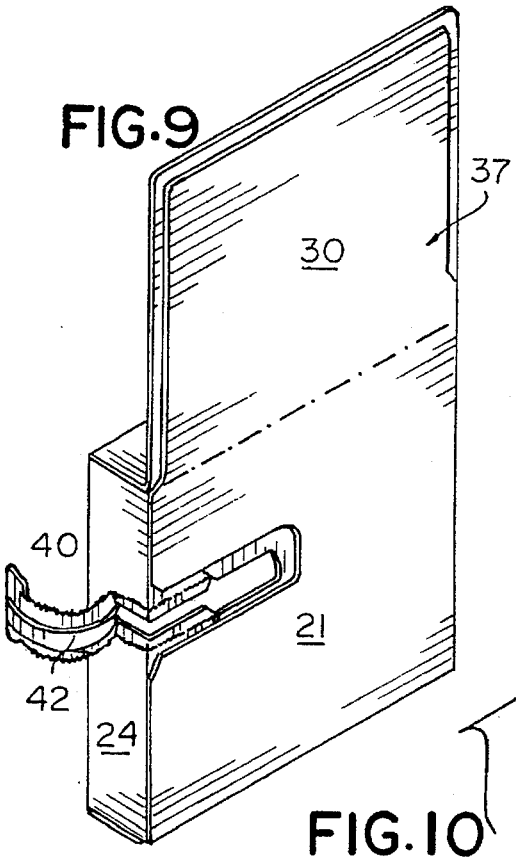
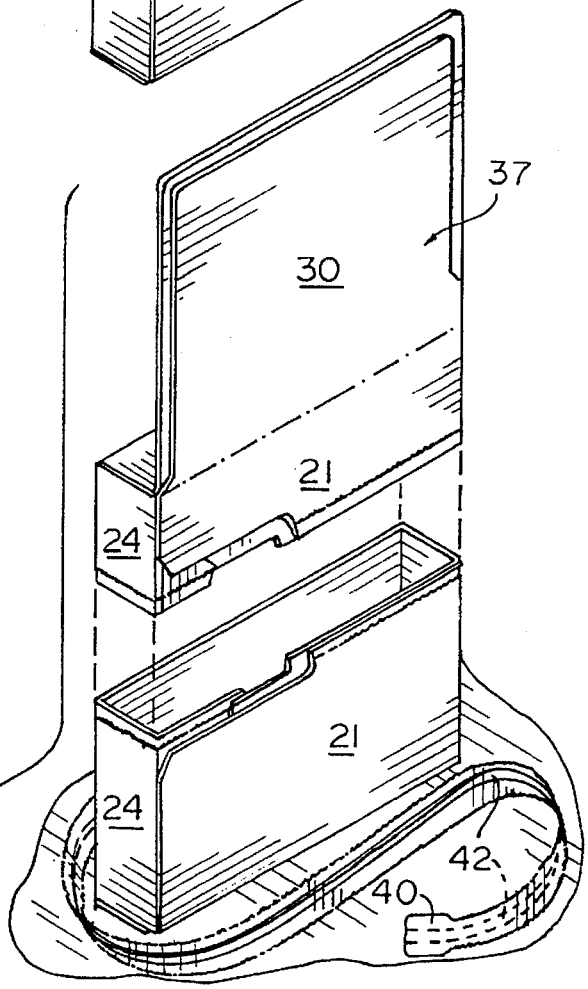
FIG. 10

CHILD RESISTANT PAPERBOARD CARTON

FIELD OF THE INVENTION

The present invention relates generally to paperboard cartons and, more particularly, relates to a method and apparatus for opening a paperboard carton that effectively prevents access to the contents of the carton by children.

BACKGROUND OF THE INVENTION

Paperboard cartons are in widespread use in the marketplace for marketing, selling and dispensing the products they contain. These cartons frequently contain toxic substances that are hazardous to humans upon ingestion or contact with skin. Such substances are commonly used in the household in such applications as toilet bowl cleaners, deodorizers, roach killers and carpet refreshers. Since these products are common in the household, potentially dangerous situations arise when children are present. As a result, it is necessary to package these substances in such a manner that the children are unable to gain access to them. This creates a need for an economical packaging and opening method for these substances that does not burden the price of the item or frustrate its efficient use.

SUMMARY OF THE INVENTION

The present invention employs a dual-tab opening mechanism that requires a degree of skill to open a package above that possessed by a child. A paperboard carton is made in the familiar fashion of folding a unitary, continuous blank to form a plurality of sides that defines an interior cavity. However, in the present invention the blank is made such that there are primary and secondary tabs integrally disposed in opposing marginal edges of the blank such that when the blank is folded the tabs are directly on top of one another and facing opposite directions.

The primary (exterior) pull tab can be pulled off to reveal the secondary (interior) pull tab. The secondary pull tab, in its preferred embodiment, is fixedly attached to a severing element in the form of a strip of reinforcing tape that is glued to the interior circumference of the carton. When the secondary pull tab is pulled, it pulls with it the reinforcing tape that sequentially slices the carton open and results in the eventual severing and opening of the carton so the contents may be dispensed.

It is an object of this invention to create a method and mechanism that facilitates ease of opening of paperboard cartons for adults and hinders access for children.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which:

FIG. 7 is a perspective view of the paperboard carton with a primary pull tab partially removed;

FIG. 8 is a perspective view of the paperboard carton with the primary pull tab completely removed and a secondary pull tab exposed;

FIG. 9 is a perspective view of the paperboard carton with the secondary pull tab completely removed and showing removal of a strip of paperboard material by use of a reinforcing tape; and FIG. 10 is a perspective view of the severed carton.

Figure 1:
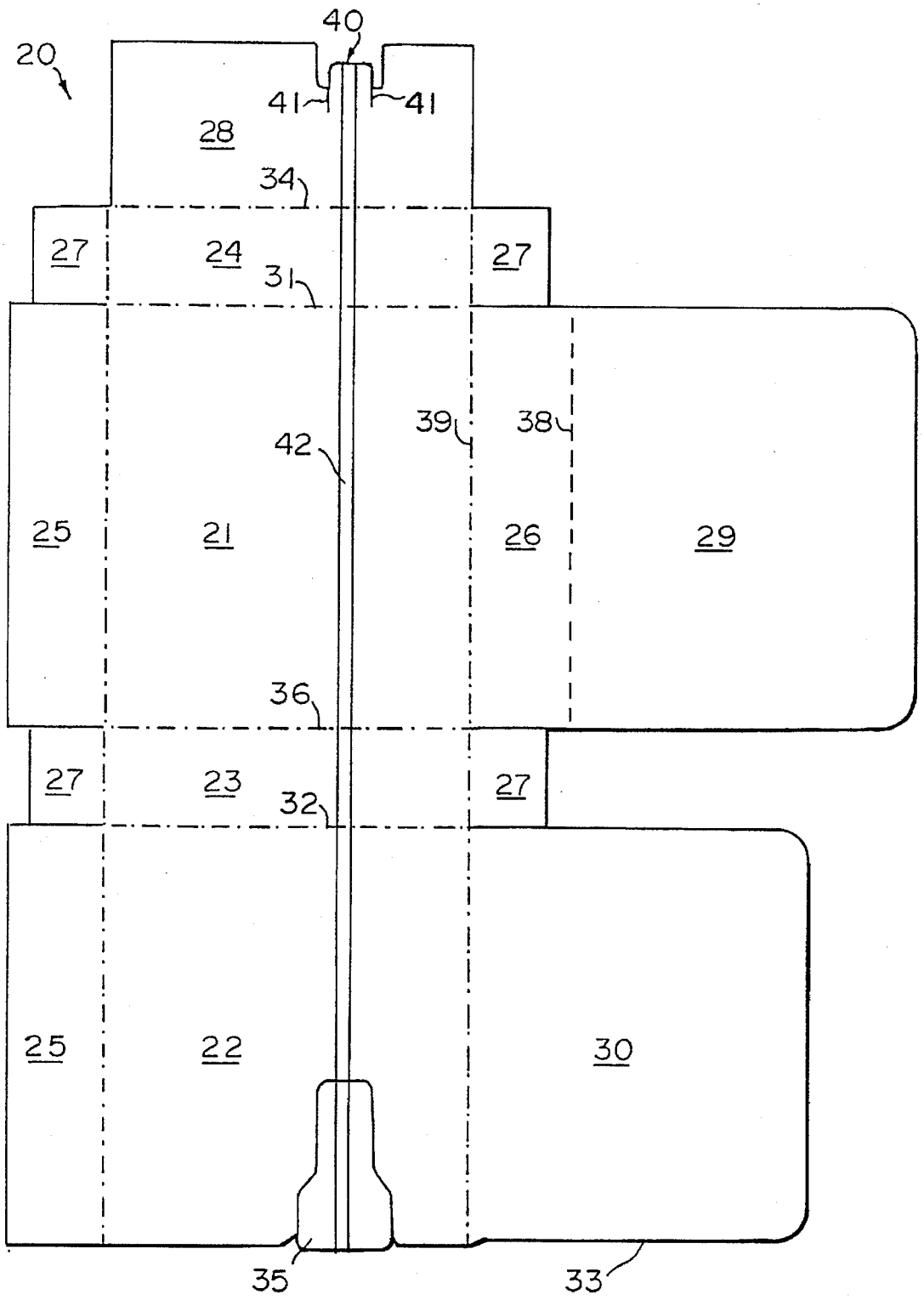
FIG. 1 is a plan view of the inside surface of a unitary, continuous blank used to form a paperboard carton embodying the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENTS

Figure 2:
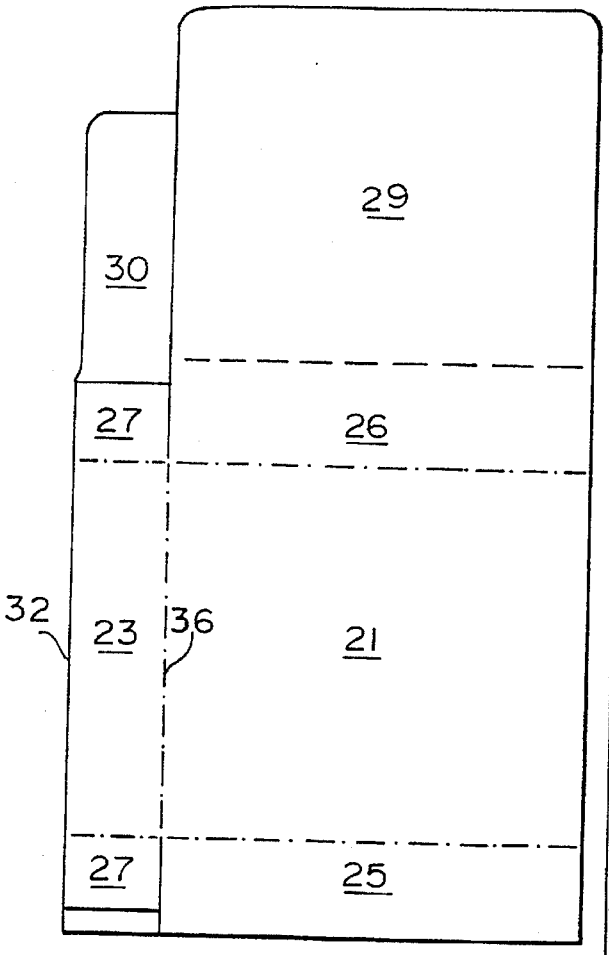
FIG. 2 is a front view of a non-erected paperboard carton in tubular form.
Figure 3:
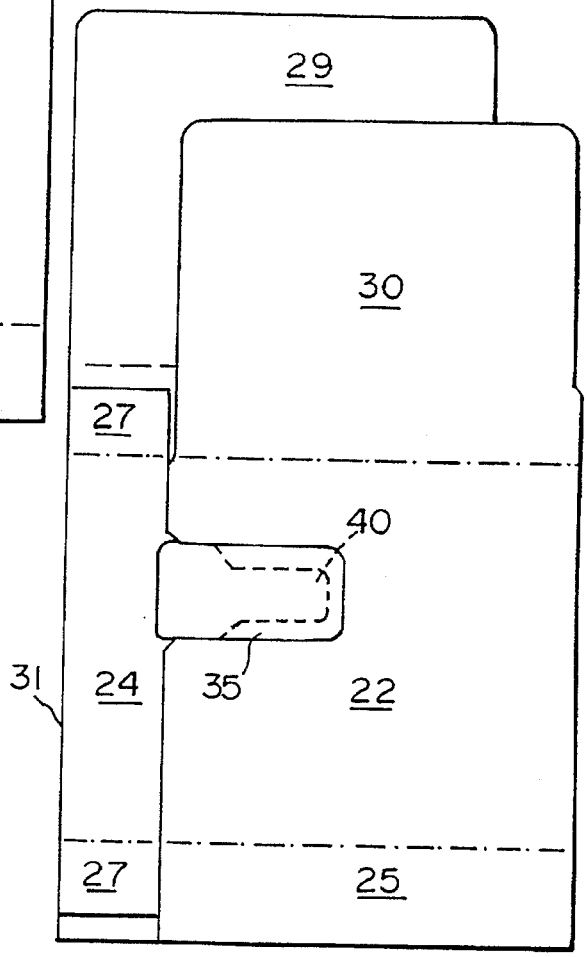
FIG. 3 is a rear view of a non-erected paperboard carton in tubular form.

Referring to FIG. 1, blank 20 is formed comprising front panel 21, back panel 22, side panels 23 and 24, major flaps 25 and 26, minor flaps 27, glue flap 28, header front 29 and header back 30. To achieve the blank configuration in FIGS. 2 and 3, side panel 24 is folded inward relative to front panel 21 approximately 180-degrees along working fold 31. Back panel 22 is folded inward relative to side panel 23 approximately 180-degrees along working fold 32 such that edge 33 is proximate and parallel to fold line 34 and back panel 22 overlaps glue flap 28. The opposing faces of glue flap 28 and back panel 22 are glued together with an adhesive and in such a manner that no adhesive is in contact with primary tab 35.

Figure 4:
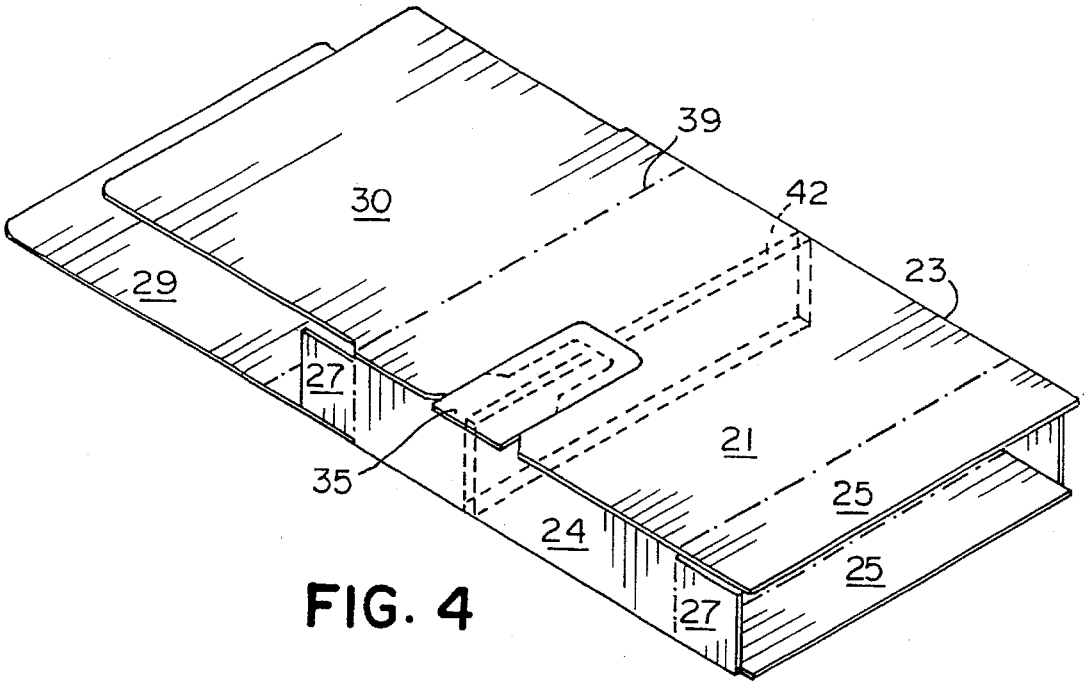
FIG. 4 is a perspective view of an erected paperboard carton in tubular form.

To achieve the blank configuration in FIG. 4, side panel 23 and side panel 24 are rotated upward approximately 90-degrees, pivoting on fold line 36 and working fold 31. At this point minor flaps 27 are folded inward such that they are perpendicular to front panel 21, back panel 22, side panel 23, and side panel 24. Major flaps 25 are then folded inward in succession such that one is on top of the other and the opposing faces of major flaps 25 are glued together with an adhesive.

Figure 5:
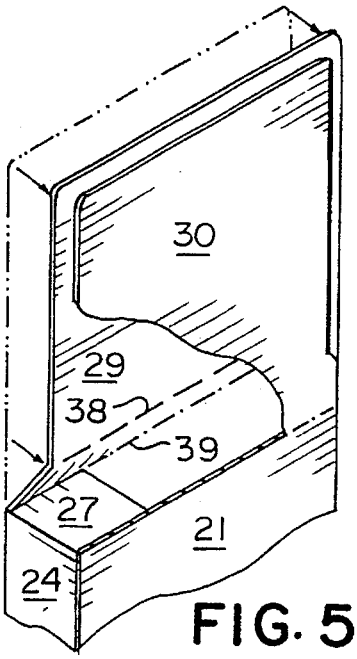
FIGS. 5 and 6 are perspective views of an upper portion of the paperboard carton showing the formation of the header.
Figure 6:
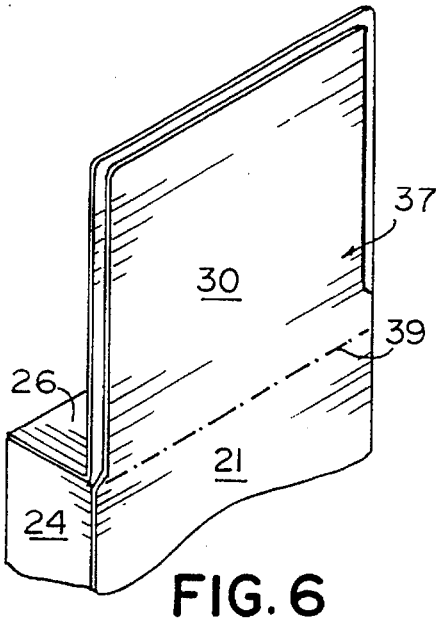

As depicted in FIGS. 5 and 6, to form header 37, a "Z" fold is imparted about fold lines 38 and 39 to bring header front 29 parallel and immediately adjacent to header back 30. Header front 29 is configured to substantially overlap header back 30. The carton is completed by gluing the opposing sides of header front 29 and header back 30 together with adhesive. The utility of the present invention is not limited to six-sided cartons, but extends also to any carton with a plurality of sides that is capable of forming a cavity and containing a given product. The function of header 37 is to facilitate display in the stores by providing a means for hanging the carton and a large display area for advertising material, instructions, warnings, etc.

The present invention employs a dual-tab opening process for opening a paperboard carton of the variety described above. A primary pull tab is used to cover and hinder access to a secondary pull tab. When the secondary pull tab is pulled it engages a severing element that effectively opens the carton along a line of severance and permits the user to dispense the product contained within. This method is most effective when used with cartons that contain toxic or harmful substances because it makes the carton more difficult for children to open.

In a preferred embodiment, primary pull tab 35 and secondary pull tab 40 are integral parts of the paperboard carton as depicted in FIG. 1. When the pull tabs are located in the relative positions shown in FIG. 1, primary pull tab 35 conceals secondary pull tab 40 in the completed carton depicted in FIG. 7. Primary pull tab 35 is defined by a U-shaped line of weakness. This line of weakness may be the result of a perforated cut, a reverse or "rev" cut, or the like. A perforated cut is characterized by a series of small, intermittent cuts that transgress both sides of the paperboard and collectively define a line of weakness. A rev cut is characterized by a pair of continuous, offset parallel cuts, on opposing sides of the paperboard, that each penetrate 30–70 percent of the thickness of the paperboard. The optimum distance is 60 percent. As the result of a rev cut, when primary pull tab 35 is pulled, the area between the two opposing cuts delaminates and releases primary pull tab 35.

Secondary pull tab 40 is preferably embodied with a free end that enables the user to firmly grasp the tab and scores 41 on either side of the tab in order to initiate the tearing of the carton. Alternatively, secondary pull tab 40 may be embodied in the same manner as primary pull tab 35 and defined by perforated or rev cuts.

In a preferred embodiment, the paperboard carton has a reinforcing tape 42 glued to the interior surface thereof. With reference to the blank in FIG. 1, this tape extends between the interior edge of primary pull tab 35 and the exterior edge of secondary pull tab 40. Alternatively, the tape may extend to the exterior edge of primary pull tab 35, as the rev cut will sever the tape and enable removal of the tab when pulled. FIG. 4 illustrates that when the blank is folded into its containerized form the tape defines a circumference around the carton.

As shown in FIGS. 7 and 8, primary pull tab 35 is easily removed due to the line of weakness and exposes secondary pull tab 40. Secondary pull tab 40 is then pulled in a direction opposite to that in which the primary pull tab 35 was pulled. This results in the sequential pulling of reinforcing tape 42 through the wall of the carton, as depicted in FIG. 9, so as to eventually completely sever the carton, as shown in FIG. 10. Alternatively, the reinforcing tape could be replaced by any line of weakness along the same path. For example, a pair of parallel perforated lines or rev cuts that are integrally or fixedly connected to secondary pull tab 40 would accomplish the same objective. Further, the line of weakness or reinforcing tape need not delineate the entire circumference of the carton. It is sufficient for purposes of this invention if the carton is severed to an extent sufficient to allow one to have access to the interior of the carton and remove the product within. It is not necessary to separate the carton and remove the top in its entirety.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A child resistant opening feature for a paperboard carton, comprising:

a secondary opening element along one side of the carton;

a primary opening element being unitarily formed from the carton, said primary opening element concealing the secondary opening element and being removably affixed to the paperboard carton, said secondary opening element being exposed upon removal of the primary opening element; and a severing element connected to the secondary opening element, the severing element tearing open the carton and allowing access to an interior thereof in response to pulling said secondary opening element.

2. A paperboard carton in accordance with claim 1 wherein the primary opening element is integrally formed with said one side of the paperboard carton and defined by a primary line of weakness.

3. A paperboard carton in accordance with claim 2 wherein the primary line of weakness includes a rev cut.

4. A paperboard carton in accordance with claim 1 wherein the secondary opening element is integrally formed in the paperboard carton.

5. A paperboard carton in accordance with claim 1 wherein the severing element includes a reinforcing tape adhered to an inner surface of at least said one side of the carton.

6. A paperboard carton in accordance with claim 1, wherein said severing element circumlocutes the carton such that removal of said severing element divides the carton into two unconnected parts.

7. A paperboard carton in accordance with claim 1, wherein said primary opening element includes a primary pull tab.

8. A paperboard carton in accordance with claim 7, wherein said secondary opening element includes a secondary pull tab.

9. A paperboard carton in accordance with claim 8, wherein said primary and secondary pull tabs are disposed for being pulled in opposite directions relative to each other.

10. A method for opening a paperboard carton made in accordance with claim 1, the method comprising the steps of:

a. removing the primary opening element so as to expose the secondary opening element; and b. pulling the secondary opening element so as to cause the severing element to tear open the paperboard carton and allow access to an interior thereof.

11. A method in accordance with claim 7 wherein the primary opening element is integrally formed in the paperboard carton and is defined by a primary line of weakness.

12. A method in accordance with claim 8 wherein the primary line of weakness includes a rev cut.

13. A method in accordance with claim 7 wherein the secondary opening element is integrally formed in the paperboard carton.

14. A method in accordance with claim 7 wherein said severing element includes a reinforcing tape adhered to an inner surface of at least said one side of the carton.

15. A method in accordance with claim 7 wherein said severing element circumlocutes the carton, and wherein step (b) comprises pulling the secondary opening element until said severing element divides the carton into two unconnected pans.

* * * * *